United States Patent [19]

Grifford

[11] Patent Number: 4,467,677

[45] Date of Patent: Aug. 28, 1984

[54] COMBINATION CHUCK KEY TOOL

[76] Inventor: Daniel W. Grifford, 1237 E. Jarvis, Hazel Park, Mich. 48030

[21] Appl. No.: 479,695

[22] Filed: Mar. 28, 1983

[51] Int. Cl.[3] ..... B25B 15/00

[52] U.S. Cl. ..... 81/439; 7/165; 7/170; 81/90 A; 279/1 K

[58] Field of Search ..... 81/439, 90 A; 7/165, 7/167, 170; 279/1 K

[56] References Cited

U.S. PATENT DOCUMENTS

| | | | |
|---|---|---|---|
| D. 180,643 | 7/1957 | Fitch | 81/439 |
| 190,119 | 5/1877 | Budd | 81/439 |
| 234,540 | 11/1880 | Collins | 81/177 ST |
| 1,516,504 | 11/1924 | Schlager | 81/439 |
| 2,519,559 | 8/1950 | Foster et al. . | |
| 2,760,799 | 8/1956 | Smith | 81/439 |
| 3,276,299 | 10/1966 | Halburian . | |
| 4,032,160 | 6/1977 | Karasa et al. | 81/90 A |
| 4,100,637 | 7/1978 | Grieser et al. | 7/165 |
| 4,125,913 | 11/1978 | Lewis | 7/165 |

FOREIGN PATENT DOCUMENTS

| | | | |
|---|---|---|---|
| 1948702 | 4/1971 | Fed. Rep. of Germany | 81/177 ST |
| 602281 | 7/1978 | Switzerland | 81/90 A |

*Primary Examiner*—Frederick R. Schmidt
*Assistant Examiner*—J. T. Zatarga
*Attorney, Agent, or Firm*—Gifford, VanOphem, Sheridan, Sprinkle & Nabozny

[57] ABSTRACT

A combination tool includes at least two chuck keys, each chuck key being individually borne on the end of a tool shaft or arm. The combination tool can also include other tool instrumentalities such as screwdrivers. Preferably, the tool comprises a pair of perpendicular tool shafts, having four chuck keys of different sizes disposed one each on the four free ends of the two shafts.

17 Claims, 5 Drawing Figures

Fig-1
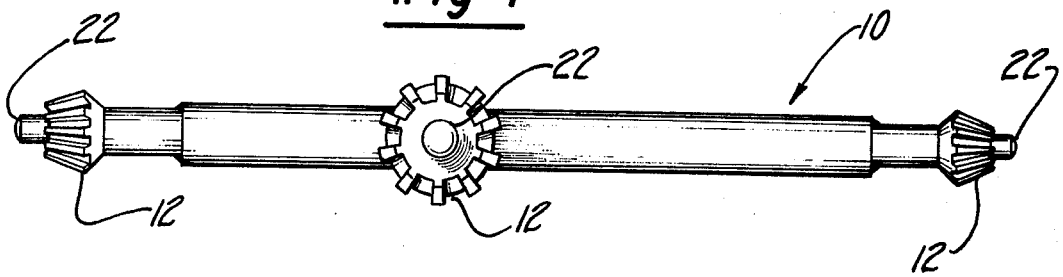
Fig-2
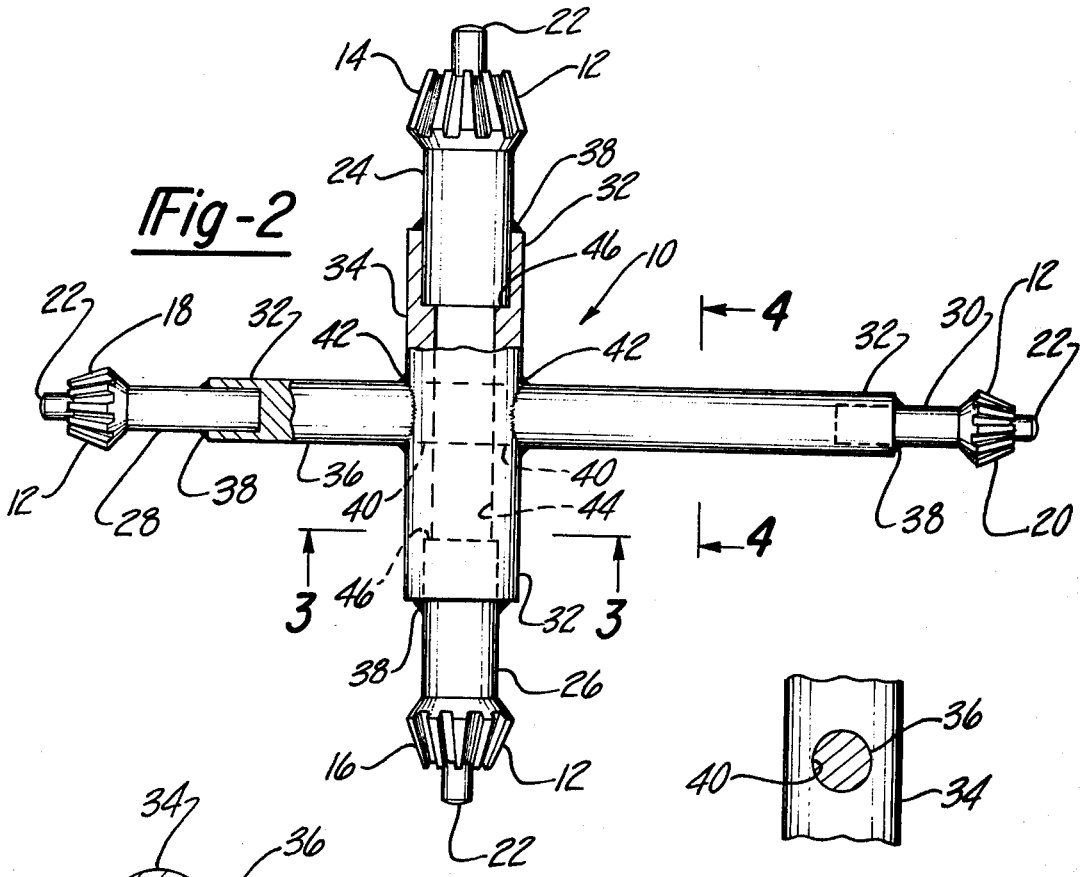
Fig-4
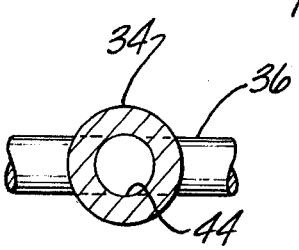
Fig-3
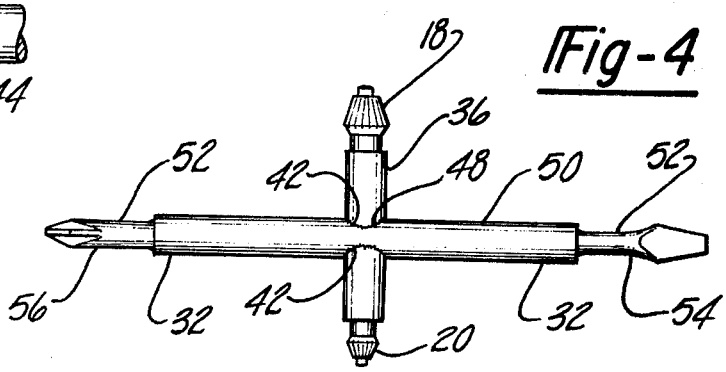
Fig-5

COMBINATION CHUCK KEY TOOL

BACKGROUND OF THE INVENTION

I. Field of the Invention

The present invention relates to combination tools, and more particularly to a combination tool having at least two chuck key bevel gears thereon.

II. Description of the Prior Art

A chuck key is a well-known tool for assisting the reversible attachment of a drill bit to a drill chuck. The chuck key comprises a fixed bevel gear on one end of a key shaft portion, and is adapted to engage a like bevel on the drill chuck. A stem on the bevel gear is engageable with a hole in the side of the drill chuck. Rotation of the chuck key loosens or tightens the grip of the drill chuck on the drill bit.

Often, and particularly often in the consumer area, a chuck key having a single bevel gear is provided with the drill when it is purchased. The chuck key is sized to fit the particular drill that it accompanies. The chuck key which is provided with the drill also typically has a fixed or removable member perpendicularly attached to the end of the key shaft portion, opposite the bevel gear. This member permits easy rotation of the chuck key about the axis of the gear and the key shaft portion, when the key is engaged with the drill chuck.

This conventional chuck key performs less than adequately in some circumstances. A particularly sized chuck can generally be interchangeably used with drills having the same sized drill chuck. However, there is a multiplicity of standard sizes for drill chucks. The most common drill chuck capacities are $\frac{1}{4}$, $\frac{3}{8}$, $\frac{1}{2}$ and $\frac{5}{8}$ inches, and there are a number of other "odd" sizes as well. Therefore, if in the past one wished to have the ability to loosen or tighten drill chucks of a variety of these sizes, one had to carry a matching multiplicity of appropriately sized chuck keys.

The inconvenience and cost of maintaining a complete set of chuck keys is clear, since an individual chuck key can easily become lost. Morover, time can be wasted searching through a multiplicity of closely-sized chuck keys for the correctly sized key.

SUMMARY OF THE PRESENT INVENTION

The present invention overcomes these and other drawbacks by providing a combination tool comprising a multiplicity of different sized chuck keys rigidly affixed (detachably or otherwise) to one another, either alone or in combination with other tool implements. In a preferred embodiment, the tool comprises four chuck keys, each comprising a stem, a bevel gear, and a key shaft portion. The chuck keys are disposed one each on the ends of two shafts, the shafts being perpendicularly and fixedly attached to one another, at or near their centers. Conveniently, the sized of the four bevel gears so disposed can correspond to the standard drill chuck capacities of $\frac{1}{4}$, $\frac{3}{8}$, $\frac{1}{2}$ and $\frac{5}{8}$ inches.

In another preferred embodiment of the present invention, two opposing chuck keys are replaced by a flat head screwdriver and a Phillips screwdriver, one on each end of the same shaft. Conveniently, for purposes of the home user, the two remaining bevel gears are sized to match the most common hand drill sizes, $\frac{1}{4}$ inch and $\frac{3}{8}$ inch.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is a side view of the preferred embodiment of the present invention;

FIG. 2 is a top and partial cross-sectional view of the preferred embodiment of the present invention;

FIG. 3 is a cross-sectional view taken substantially along line 3—3 in FIG. 2;

FIG. 4 is a cross-sectional view taken substantially along line 4—4 in FIG. 2; and FIG. 5 is a top view of another preferred embodiment of the present invention.

DETAILED DESCRIPTION OF THE PREFERRED EMBODIMENTS OF THE PRESENT INVENTION

With reference now to FIGS. 1 and 2, the combination tool 10 of the present invention is thereshown and first comprises a multiplicity of different sized bevel gears 12. Each of the bevel gears 12 is adapted to engage a like bevel on a matchingly sized drill chuck (not shown). Preferably, the multiplicity of gears 12 comprises four bevel gears 14, 16, 18 and 20, adapted to loosen or tighten drill chucks of $\frac{5}{8}$, $\frac{1}{2}$, $\frac{3}{8}$ and $\frac{1}{4}$ inch capacity, respectively. A stem 22 extending outwardly from each of the bevel gears 12 is fittable into a matching hole in the corresponding drill chuck, in the well known fashion.

Each of the bevel gears 14, 16, 18 and 20 is rigidly attached to one end of a corresponding key shaft portion 24, 26, 28 and 30, respectively. The other end of each of the key shaft portions 24, 26, 28 and 30 is rigidly attached to a separate tool shaft end 32. Preferably, there are four tool shaft ends 32, two each on a first tool shaft 34 and on a second tool shaft 36. Preferably also, each of the key shaft portions 24, 26, 28 and 30 is partly embedded into the corresponding tool shaft end 32. The key shaft portions 24, 26, 28 and 30 are held in their corresponding tool shaft ends 32 by welds 38.

The tool shafts 34 and 36 are rigidly attached to one another at or near their centers. Preferably, the second tool shaft 36 is of a somewhat lesser diameter than is the first tool shaft 34, so that their attachment occurs by the positioning of the second tool shaft 36 in a throughbore 40 (FIGS. 2 and 4) in the first tool shaft 34. Means such as welds 42 affix the second tool shaft 36 in the throughbore 40.

The positioning of the second tool shaft 36 in the first tool shaft 34, and the embedding of the key shaft portions 24 and 26 into the tool shaft ends 32, are eased by the provision of an axial bore 44 (FIGS. 2 and 3) longitudinally disposed through the first tool shaft 34. A pair of shoulders 46 can be provided in the longitudinal axial bore 44 in order to limit the insertion of the key shaft portions 24 and 26 into the bore 44.

Use of the combination chuck key 10 of the present invention is straightforward. The stem 22 of the appropriately sized bevel gear 14, 16, 18 or 20 is inserted into the hole conventionally provided on the drill chuck (not shown), and the teeth on the bevel gear 14, 16, 18 or 20 are engaged with the teeth of the like bevel on the drill chuck. Appropriate rotation of the tool 10 about the axis of the inserted key shaft member results in the desired loosening or tightening of the grip of the drill chuck on the inserted drill bit.

The tool shaft 34 or 36 which does not carry the bevel gear 14, 16, 18 or 20 so engaged permits torque to be more easily applied to the engaged bevel gear 14, 16, 18 or 20. This torque allows loosening of a too tightly locked drill chuck, or allows the chuck to be tightened sufficiently to prevent loss of the drill bit during its use.

Another preferred embodiment of the present invention is shown in FIG. 5, wherein the multiplicity of gears 12 comprises only two bevel gears 18 and 20, which again fit drill chucks of $\frac{3}{8}$ inch and $\frac{1}{4}$ inch capacity, respectively. These two drill gears 18 and 20 are carried on the second tool shaft 36 as before, but are received instead in a throughbore 48 centrally disposed in a tool implement shaft 50. The tool shafts 36 and 50 are preferably rigidly affixed to one another by the use of means such as the welds 42. The ends 32 of the tool implement shaft 50 do not carry bevel gears thereon, but rather bear other tool implements 52. For example, these tool implements 52 preferably can comprise a flat-head screwdriver 54 and a Phillips head screwdriver 56, but other tool implements can be useful as well. The implements 52 can be employed in their conventional fashion.

This embodiment of the present invention is particularly useful for purchasers of hand-held, consumer oriented drills, since most consumer drills have drill chuck capacities of either $\frac{1}{4}$ inch or $\frac{3}{8}$ inches.

Having described my invention, however, many modifications thereto will become apparent to those skilled in the art to which it pertains without deviation from the spirit of the invention as defined by the scope of the appended claims. Constructing the present invention can be straightforward if each of the key shaft portions, the bevel gears, and the stems are formed as a unit, for example, by being cut as a unit from previously manufactured individual chuck keys. Also, the first and second tool shafts need not be of cylindrical shape but can be otherwise formed.

The multiplicity of chuck keys alternatively can be carried on an odd or even number of arms, these arms depending from a central point at which each of the arms is rigidly affixed to the others. Each of these arms substantially comprises one-half of one of the previously described tool shafts, so that each of the preferred embodiments shown herein would, for example, comprise four of such arms.

Finally, although the shaft and key shaft portions are described as rigidly affixed to one another, this fixing can be detachable (by means known) instead of by welding. Other modifications will be obvious in light of this disclosure.

I claim:

1. A combination tool comprising a multiplicity of tool shafts rigidly affixed to one another, each of said shafts having opposing ends, and each of said ends carrying a tool instrumentality thereon, wherein at least two of said instrumentalities comprise chuck keys, each of said chuck keys comprising a key shaft portion; wherein one of said shafts is of a larger diameter than each of the others of said shafts, said larger diameter shaft comprising a first portion defining an axial throughbore therein, said axial throughbore having a diameter at least equal to the largest diameter of each of the others of shafts; and wherein the key shaft portion of at least one of said chuck keys is fixedly secured in said axial throughbore; said larger diameter shaft comprising a second portion defining a diametric throughbore therein, one of the others of said shafts being affixed in said diametric throughbore.

2. The invention according to claim 1 wherein said shafts are two in number.

3. The invention according to claim 1 wherein each of said shafts are detachably affixed to one another.

4. The invention according to claim 1 wherein each of said shafts are fixedly attached to one another.

5. The invention according to claim 1 wherein said shafts number no more than three, and said shafts are perpendicularly disposed to one another.

6. The invention according to claim 1 wherein at least one of said instrumentalities comprises a screwdriver.

7. The invention according to claim 1, wherein all of said instrumentalities comprise chuck keys of different sizes.

8. The invention according to claim 1, wherein said first portion comprises a shoulder restricting the insertion of said key shaft portion into said axial throughbore.

9. A combination tool comprising a first tool shaft and at least one arm, said first shaft having a pair of opposing ends each carrying a tool instrumentality thereon, and each of said arms having a first end and a second end, each of said arms being rigidly affixed to said first shaft at said first end of each of said arms, and each of said arms carrying a tool instrumentality on said second end thereof; wherein at least one of said instrumentalities on said first shaft comprises a chuck key, said chuck key comprising a key shaft portion; wherein said first shaft comprises a first portion defining an axial throughbore therein, said axial throughbore having a diameter at least equal to the diameter of any of said arms; and wherein the key shaft portion of said chuck key is fixedly secured in said axial throughbore; said first shaft comprising a second portion defining at least one transverse bore therein in communication with said axial throughbore, said first end of each of said at least one arms being disposed in one of said transverse bores.

10. The invention according to claim 9, wherein all of said instrumentalities comprise chuck keys of different sizes.

11. The invention according to claim 9, wherein said first portion comprises a shoulder restricting the insertion of said key shaft portion into said axial throughbore.

12. The invention according to claim 9 wherein said arms are two in number.

13. The invention according to claim 9 wherein each of said arms are detachably affixed to said tool shaft.

14. The invention according to claim 9 wherein each of said arms are fixedly attached to said tool shaft.

15. The invention according to claim 9 wherein said arms number no more than four and wherein said arms are orthogonally disposed to one another.

16. The invention according to claim 15 wherein at least one pair of said arms comprises a second shaft.

17. The invention according to claim 9 wherein at least one of said instrumentalities comprises a screwdriver.

* * * * *